US006532945B1

(12) United States Patent
Chattin

(10) Patent No.: US 6,532,945 B1
(45) Date of Patent: Mar. 18, 2003

(54) ENHANCER FOR COMPOUND BOWS

(75) Inventor: Jessie R. Chattin, Tampa, FL (US)

(73) Assignee: Vibraguard Corp., Tampa, FL (US)

( * ) Notice: Subject to any disclaimer, the term of this patent is extended or adjusted under 35 U.S.C. 154(b) by 0 days.

(21) Appl. No.: 09/689,160

(22) Filed: Oct. 12, 2000

(51) Int. Cl.[7] ..... F41B 5/10
(52) U.S. Cl. ..... 124/25.6; 124/86
(58) Field of Search ..... 124/23.1, 25.6, 124/86, 88; 267/149

(56) References Cited

U.S. PATENT DOCUMENTS

| | | | | | |
|---|---|---|---|---|---|
| 3,968,958 | A | * | 7/1976 | Huchette et al. | 267/149 X |
| 4,407,261 | A | * | 10/1983 | Elliott | 124/25.6 X |
| 4,475,723 | A | * | 10/1984 | Meyer | 267/149 X |
| 4,519,591 | A | * | 5/1985 | Bush et al. | 267/149 X |
| 4,530,490 | A | * | 7/1985 | Misumi et al. | 267/149 X |
| 4,593,674 | A | * | 6/1986 | Kudlacek | 124/25.6 |
| 4,596,228 | A | * | 6/1986 | Smith | 124/25.6 |
| 4,834,061 | A | | 5/1989 | Chattin | 124/86 |
| 5,722,385 | A | * | 3/1998 | Bunk | 124/86 |
| 5,983,880 | A | * | 11/1999 | Saunders | 124/25.6 |
| 6,152,124 | A | * | 11/2000 | Gallops | 124/25.6 |
| 6,178,958 | B1 | * | 1/2001 | Gallops | 124/25.6 |

* cited by examiner

*Primary Examiner*—John A. Ricci
(74) *Attorney, Agent, or Firm*—Holland & Knight LLP

(57) ABSTRACT

An enhancer assembly for connection to a compound bow by means of a bracket that mounts the enhancer assembly to the compound bow at a position proximate to the cables in a position off-set from the bowstring to retain the cables from being in the path of the bowstring. The enhancer assembly comprises an enhancer composed of a non-metal material and at least one cable guide connected to one end of the enhancer for slidably receiving the cables, whereby the enhancer reduces the amount of shock and noise produced upon release of the drawn bowstring to propel an arrow and increase the speed of the arrow.

21 Claims, 11 Drawing Sheets

16A
18A
20
16
20A
20B
11A
12
10
34
32
L
(REST)
30
32S
30A
11B
14
X
20A
20B
20
16
16B
18B 18A
16A
16
20
20A
20B
11A
12
10
34
32
L
(LOAD)
30
32S
30A
11B
14
20
X
20A
20B
16
16B
18B

ENHANCER FOR COMPOUND BOWS

BACKGROUND OF THE INVENTION

1. Description of the Invention

This invention relates to compound bow enhancers and more particularly to enhancers that reduce noise and vibrations while increasing arrow speed.

2. Description of the Background Art

In a traditional compound bow, a bowstring is connected by a pair of cables over respective eccentric pulleys or cams connected to the bow tips and then cross over to the opposite limbs where the ends are attached directly or indirectly to the bow limb. In more modern compound bows, only one cam is utilized.

One drawback of the compound bow is the noise generated upon releasing the bowstring to propel the arrow. When the bowstring reaches the end of its arrow-propelling path, the cables are propelled forwardly causing considerable hand shock. The portion of the cables which cross in the middle portion of the bow rub against each other to produce noise and waste kinetic energy. If used while hunting, the noise may alert game birds and animals.

In my prior patent, U.S. Pat. No. 4,834,061, the disclosure of which is hereby incorporated by reference herein, I disclosed a bilateral cable vibraguard (see FIG. 2 of U.S. Pat. No. 4,834,061) that reduced noise of the bowstring. My prior cable vibraguard reduced vibrations; however, because it was composed of spring steel, it quickly fatigued after about 200 draws. Due to such unavoidable premature fatiguing, my prior bilateral cable vibraguard was only prototyped and never commercialized.

It is an object of this invention to a provide compound bow enhancer that functions as a vibraguard to dampen the noise generated by the crossing cables which would otherwise rub against one another upon release of the drawn bowstring.

Another object of this invention is to provide a compound bow enhancer for reducing hand shock.

Another object of this invention is to provide a compound bow enhancer to increase the speed-of-flight of the arrow as it is propelled forward.

The foregoing has outlined some of the more pertinent objects of the present invention. These objects should be construed to be merely illustrative of some of the more pertinent features and applications of the invention. Many other beneficial results can be obtained by applying the disclosed invention is a different manner or modifying the invention within the scope of the disclosure. Accordingly, other objects and a fuller understanding of the invention may be had by referring to the summary of the invention and the detailed description describing the preferred embodiment in addition to the scope of the invention defined by the claims taken in conjunction with the accompanying drawings.

SUMMARY OF THE INVENTION

The invention is defined by the appended claims with a specific embodiment shown in the attached drawings. For purposes of summarizing the invention, the invention comprises a enhancer assembly for use with a conventional compound bow.

Conventional compound bows have a pulley or cam mounted at the ends of the bow limbs. A bowstring is connected to a pair of cables. The cables are threaded around respective cams mounted at the ends of the bow limbs, then cross over each other at the midportion of the bow and are then connected to the respective end of the other bow limbs.

In its preferred embodiment, the enhancer assembly of the invention comprises a non-metal enhancer having an elongated configuration with cable guides on its ends for receiving the cables. The enhancer is coupled at its midportion to one end of an elongated bracket. The other end of the elongated bracket is connected to the handle portion of the bow. The bracket serves to adjustably position the enhancer at a rest position proximate to the crossing cables such that the cable guides separate the cables from one another to prevent them from rubbing against one another.

During drawing of the bowstring, the bow limbs arc rearwardly. The cables, being stretched between the ends of the bow limbs, likewise move rearwardly to bend the enhancer rearwardly in the direction of the arcing bow limbs. Upon release of the bowstring, the bow limbs propel the bowstring (and arrow) forwardly. Simultaneously, the enhancer propels the crossing cables forwardly. As the cables are entrained within the cable guides, they remain separated at all times. Further, as the enhancer is composed of a non-metal, the back-and-forth movement of the enhancer after release, is significantly dampened. Hand shock and noise are therefore substantially minimized. Furthermore, an increase in arrow speed is achieved due to the increased dynamic efficiency.

Furthermore, it has been found that a significant increase in arrow speed can be obtained by "pre-loading" the enhancer. More particularly, by shortening the bracket to reposition the enhancer forwardly of its at normal at-rest position to a "pre-loaded" position, the enhancer is bent by the crossing cables into a slight arc rearwardly. Upon drawing of the bow, the enhancer arcs more rearwardly, and upon release, a meaningful increase in arrow speed can be achieved with only a negligible increase in draw length and draw weight.

As noted, the enhancer is preferably composed of a non-metal material such as a synthetic material preferably in the form of a fiberglass. The enhancer composed of a synthetic material such as fiberglass results in an enhancer that is resilient with essentially permanent memory. The permanent resiliency results in a enhancer that (1) is long-lasting for multitudes of flexes without fatigue, (2) is more bendable to greater arcs without fatigue or loss of memory, (3) minimizes hand-shock as is bent to an arcuate configuration and released to return to its at-rest position, (4) has a greater damping coefficient than metal resulting in faster damping without ringing, and (5) absorbs sound better than metal. In contrast, my prior vabraguard composed of metal as disclosed in my prior art patent, fatigued too quickly and lost memory due to the repetitive back-and-forth bending of the metal, produced significant hand-shock, and tended to "ring" thereby compromising the purpose of being a enhancer.

It is believed that many composites of synthetic materials may be employed such as those containing graphite or other strengthening materials. It is also believed that many orientations of the fibrous materials embedded in the composite may be employed. Currently, it is believed that the best implementation of the enhancer is achieved using compression molding of fiberglass in which the glass fibers run the full elongated length of the enhancer.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

A

Similar reference characters refer to similar parts throughout the several views of the drawings.

DETAILED DESCRIPTION OF THE PREFERRED EMBODIMENT

Figure 1:
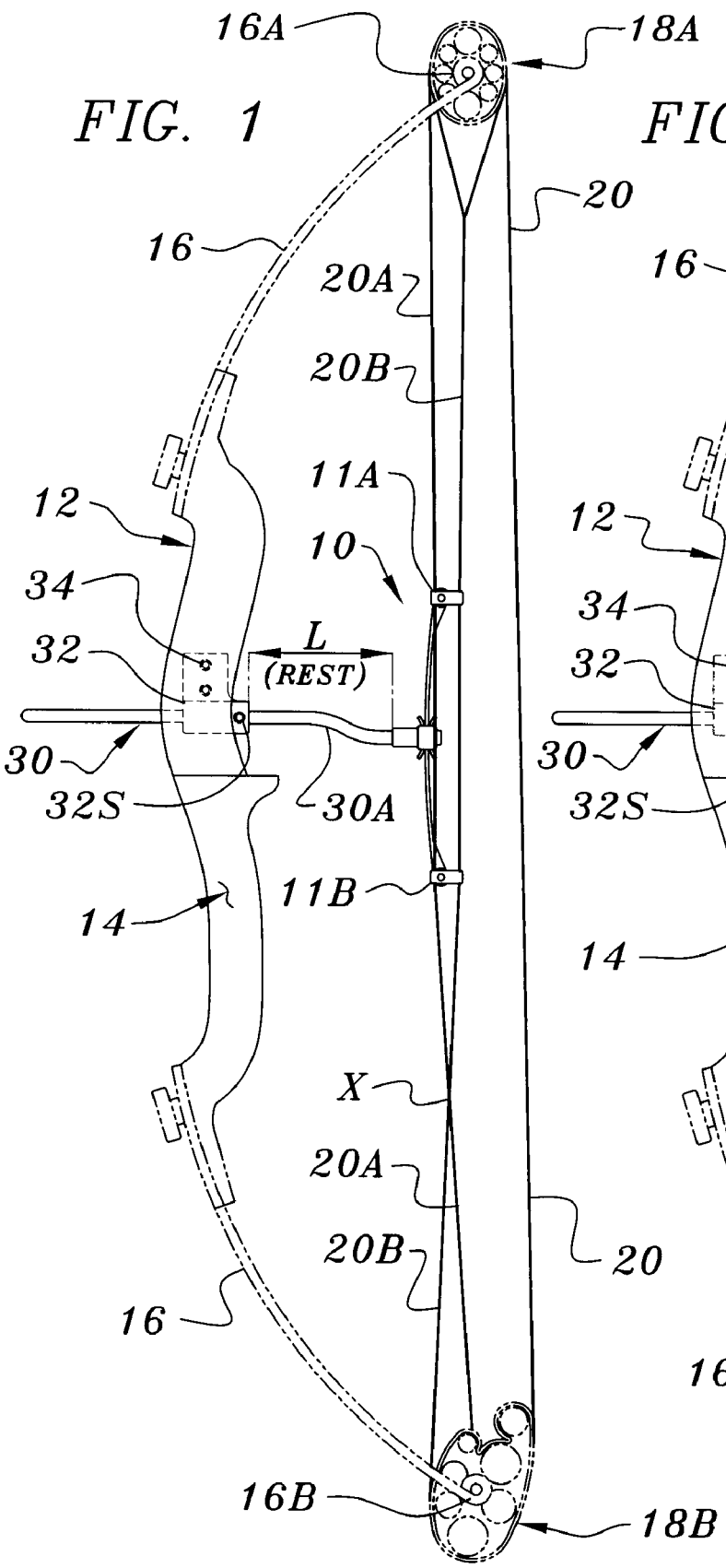
FIG. 1 is a side view illustrating the enhancer assembly of the invention attached to a compound bow in an at-rest position.

FIG. 1 is a side view illustrating the first embodiment of the enhancer 10 assembly of the invention. The enhancer assembly 10 of the invention is used with a conventional compound bow 12 having a bow handle 14 and a pair of outwardly extending bow limbs 16. A pair of eccentric pulleys such as cams 18A and 18B are rotatably journalled to the respective ends 16A and 16B of the bow limbs 16. A bowstring 20 is provided with cables 20A and 20B at the ends thereof. The bowstring 20 extends between the cams 18 with the cables 20A and 20B respectively wound around the cams 18A and 18B. The cables 20A and 20B are then crossed-over at cross-over point X and their ends respectively connected to the other ends 16B and 16A of the bow limbs 16. It is noted that the enhancer assembly 10 of the invention is operable with many makes and models of compound bows 12. For example, the enhancer assembly 10 of the invention is operable with compound bows 12 employing only one cam.

The enhancer assembly 10 of the invention is mounted to the compound bow 12 by an elongated bracket 30 with the cables 20 being entrained through respective cable guides 11A and 11B connected to the ends of the enhancer assembly 10. The bracket 30 serves two purposes. Firstly, the bracket includes an off-set 30A portion for off-setting the enhancer assembly 10 to the outside of the line of path of the bowstring 20 (see FIGS. 4 and 5) so that the cables 20 are forced to the outside by being entrained in the cable guides 11A & 11B and to not otherwise obstruct the flight of the arrow (not shown). Secondly, the bracket 30 serves to position the enhancer assembly 10 rearwardly in alignment with or forwardly of the crossing cables 20.

Figure 2:
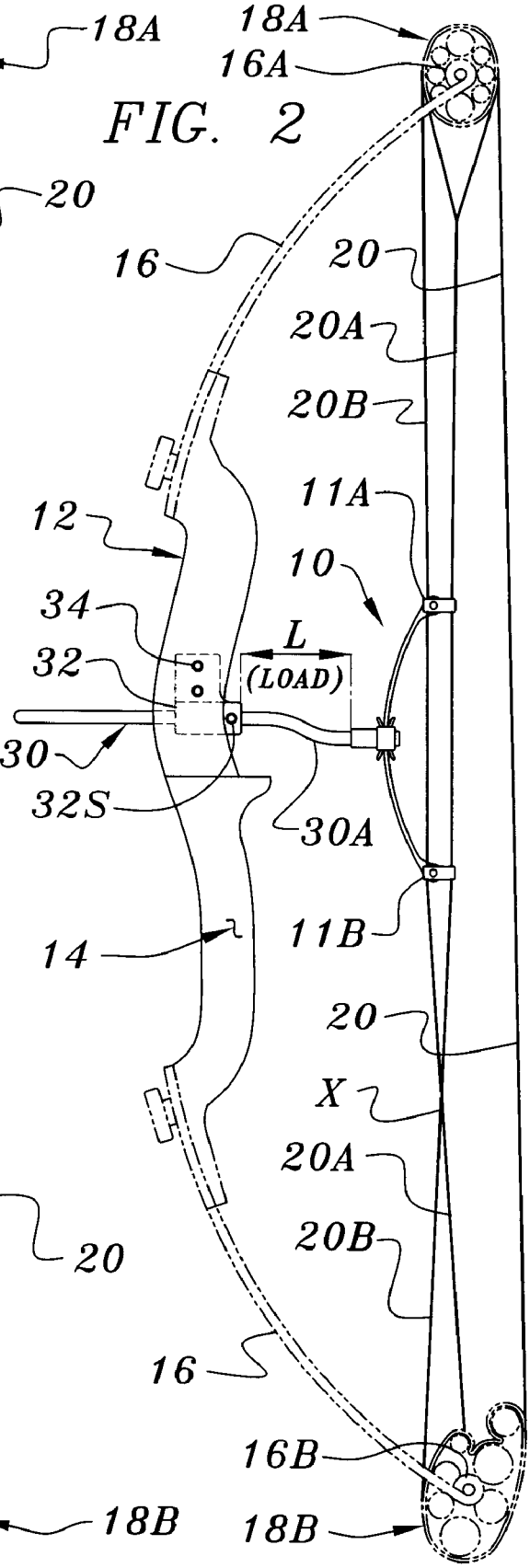
FIG. 2 is a side view illustrating the enhancer assembly of the invention attached to a compound bow in a pre-loaded position.

More specifically, the bracket 30 is preferably adjustably connected through a hole in an attachment plate 32, such as by means of one or more set-screws 32S. For retrofitting, the attachment plate 32 may include a series of holes 32 formed therein for receiving screws or bolts for securing the attachment plate 32 to the bow handle 14. Alternatively, the attachment plate 32 may be integrally formed within the bow handle 12 during the manufacture thereof. For reasons explained below in greater detail, the adjustability of the bracket 30 permits its length L to be adjusted to position the enhancer assembly 10 relative to the crossing cables 29A and 20B. Thus, as shown in FIG. 1, the length $L_{rest}$ of the elongated bracket 30 is in an "at-rest" position when the enhancer assembly 10 of the invention is aligned with the crossing cables 20A and 20B and, as shown in FIG. 2, in a "pre-loaded" position when the length $L_{load}$ of the bracket 30 is shortened to position the enhancer assembly 10 forwardly of the at-rest position ($L_{load}<L_{rest}$).

Figure 3:
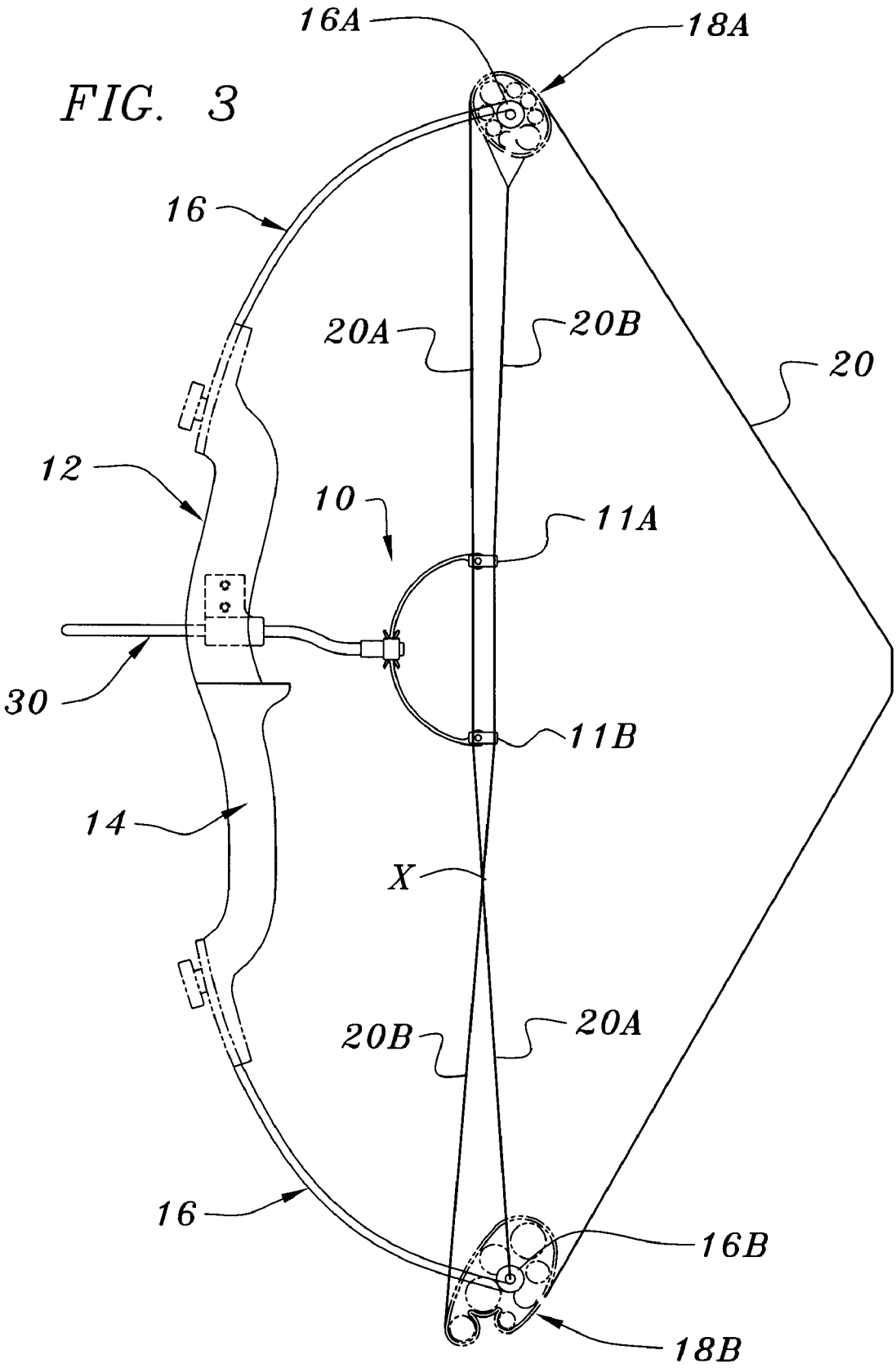
FIG. 3 is a side view illustrating the enhancer assembly of the invention attached to a compound bow in a drawn position.

As shown in FIG. 3, upon drawing of the bowstring 20, the bow limbs 16 are arced rearwardly. Simultaneously, the cables 20 are forced rearwardly and force the enhancer assembly 10 to arc rearwardly. Upon release, the bow limbs 16 propel the bowstring 20 (and arrow) forwardly with great speed to propel the arrow into flight. Simultaneously, the enhancer assembly 10 propels the cables 20 forward. As explained below in greater detail, the enhancer assembly 10 serves to reduce hand shock and noise and serves to increase the speed of the propelled arrow. Further, as explaned below, if the enhancer assemble is preloaded as shown in FIG. 2, more significant increased air speed can be achieved.

Turning now to FIGS. 6, 7, 11, 12 & 13, the enhancer assembly 10 comprises an enhancer 40 having, in one embodiment, an elongated generally planar, elongated configuration with the cable guides 11A & 11B pivotally connected to the ends thereof by means of pivot pins 42 that extend through respective holes 44 in each of the cable guides 11A & 11B and a corresponding aligned hole 46 formed in the bulbous ends of the enhancer 40. As shown, the axis of the pivot pin 42 is generally parallel to the plane of the enhancer 40. The generally planar configuration of the enhancer 40 is preferred in this embodiment due to its ability to flex rearwardly upon drawing of the bow as shown in FIG. 3 while minimizing twisting due to the offset positioning of the enhancer assembly 10 from the path of the bowstring 20.

Figure 4:
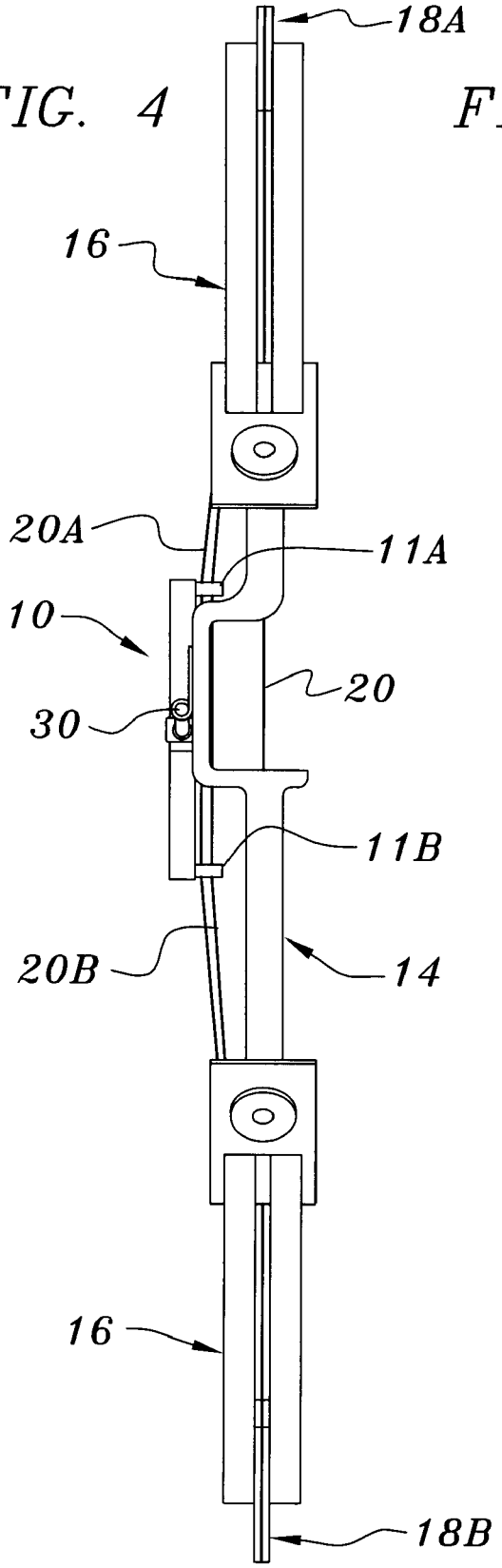
FIG. 4 is a partial front view of FIG. 1.
Figure 5:
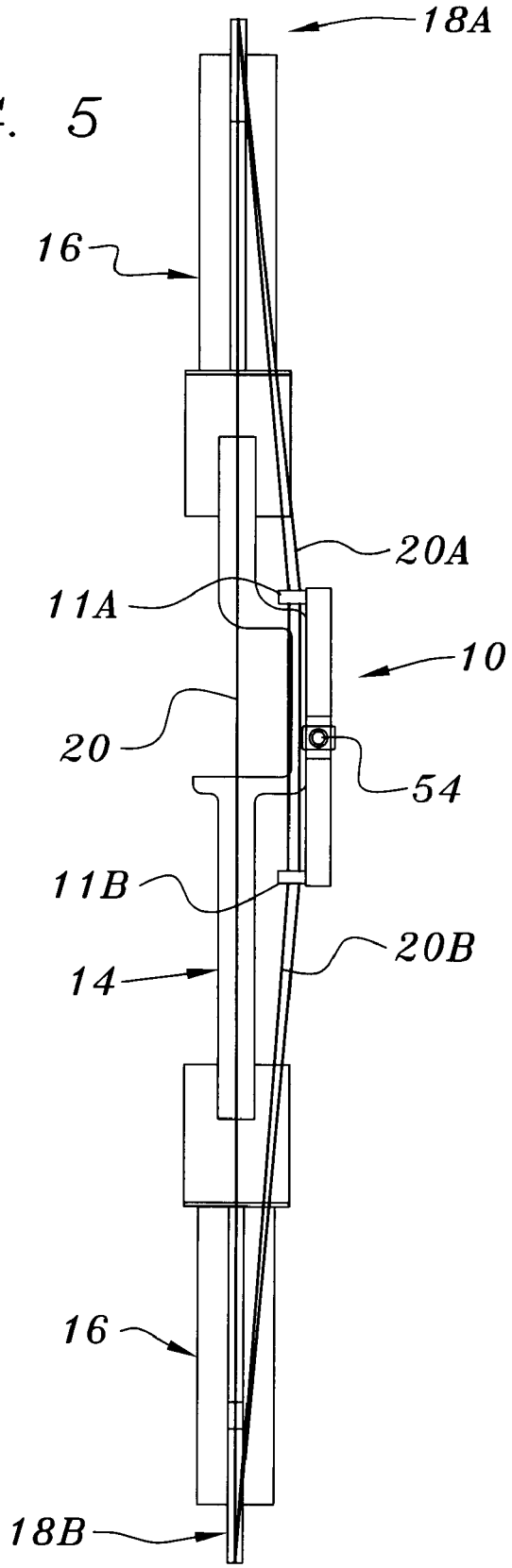
FIG. 5 is a partial rear view of FIG. 1.

As noted above, the cable guides 11A & 11B function to entrain the cables 20A & 20B (1) to separate them and prevent them from rubbing at the point of cross-over X, (2) to pull them outwardly away from the path of the bowstring 20 to an off-set position as shown in FIGS. 4 and 5 and (3) to allow the cables 20 to bend the enhancer 40 rearwardly upon drawing of the bowstring 20 whereupon upon release of the bowstring 20, the cables 20 are forcibly urged forwardly by the enhancer 40 and then dampened to minimize shock and noise. The cable guides 11A & 11B may thus comprise many configurations without departing from the spirit and scope of the invention.

Figure 8:
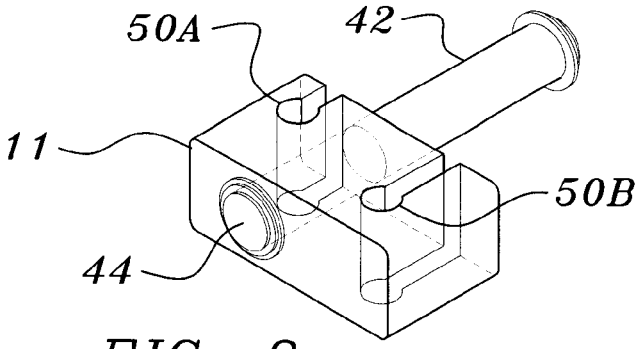
FIG. 8 is a perspective view of the first embodiment of the cable guides.
Figure 9:
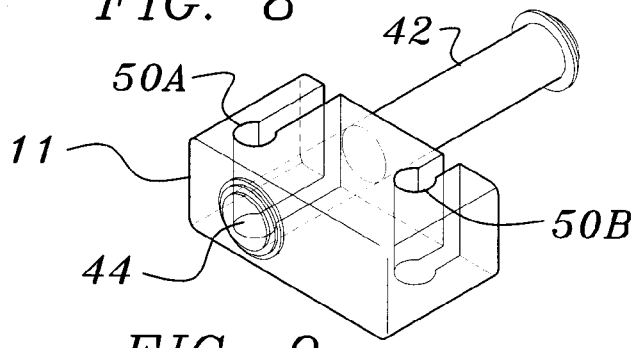
FIG. 9 is a perspective view of the second embodiment of the cable guides.
Figure 10:
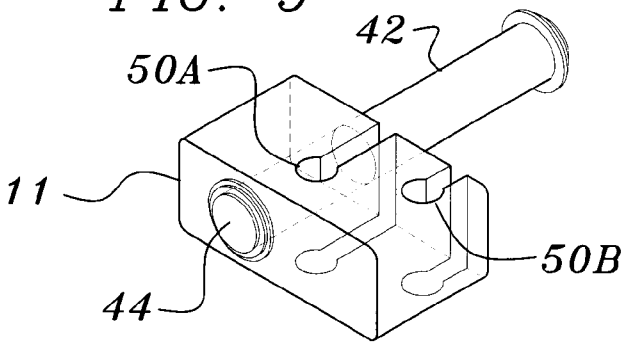
FIG. 10 is a perspective view of the third embodiment of the cable guides.
Figure 10A:
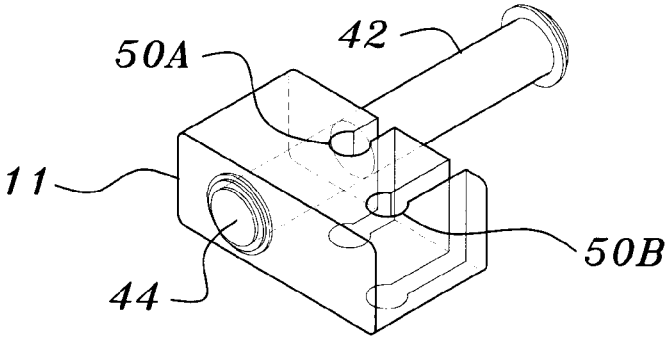
FIG. 10A is a perspective view of the fourth embodiment of the cable guides.

More particularly, in one embodiment shown in FIG. 8, one of the cable guides 11A & 11B may comprise a generally rectangular configuration with cable slots 50A and 50B being formed therein from the side closest to the enhancer 40, with cable slot 50B being formed deeper than cable slot 50A and with the slots 50 being positioned on opposing sides of the pivot pin hole 44. In another embodiment as shown in FIG. 9, cable guide 11A & 11B is similarly configured but with the cable slot 50A being formed deeper than cable slot 50B. In the embodiment of the cable guide 11A & 11B shown in FIG. 10, both cable slots 50A and 50B are formed to one side of the pivot pin hole 44 with slot 50A likewise being deeper than slot 50B. Finally, similar to the embodiment of FIG. 9, the embodiment of the cable guide 11A & 11B shown in FIG. 10A both cable slots 50A and 50B are formed to one side of the pivot pin hole 44 but slot 50A is formed shallower than slot 50B.

Figure 6:
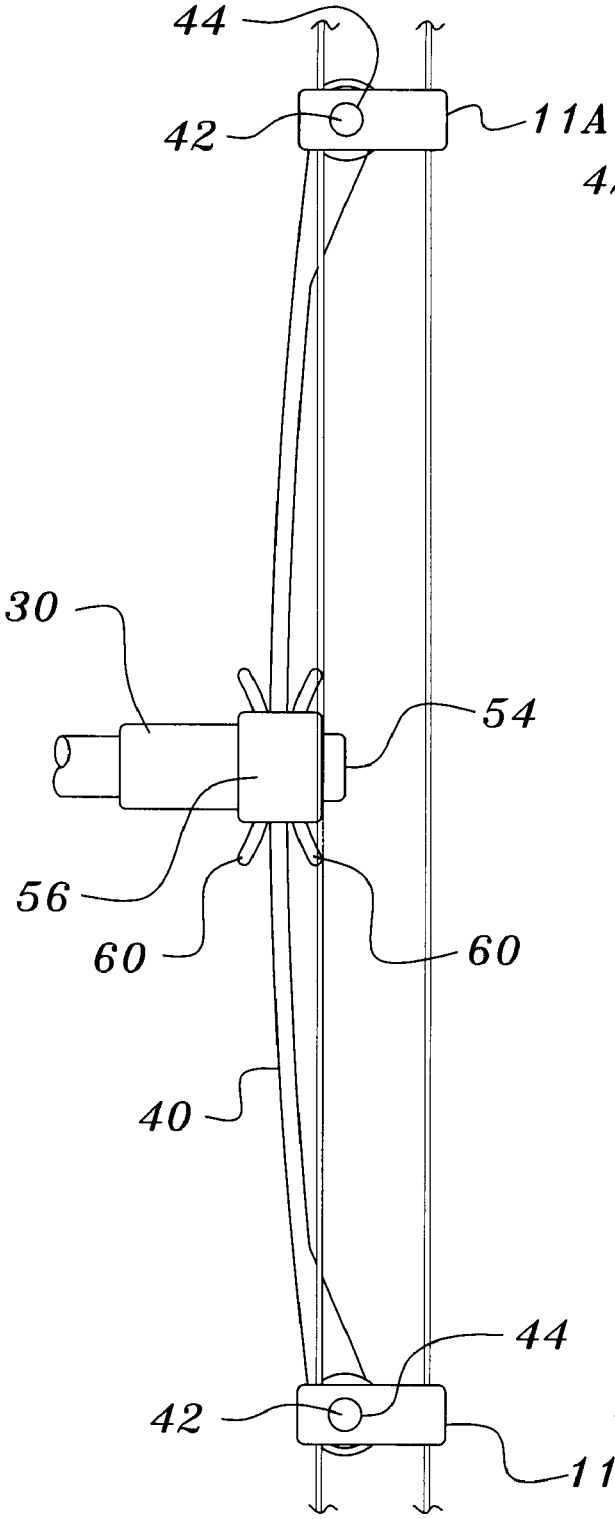
FIG. 6 is an enlarged side view of the enhancer assembly of FIG. 1 absent the compound bow.
Figure 7:
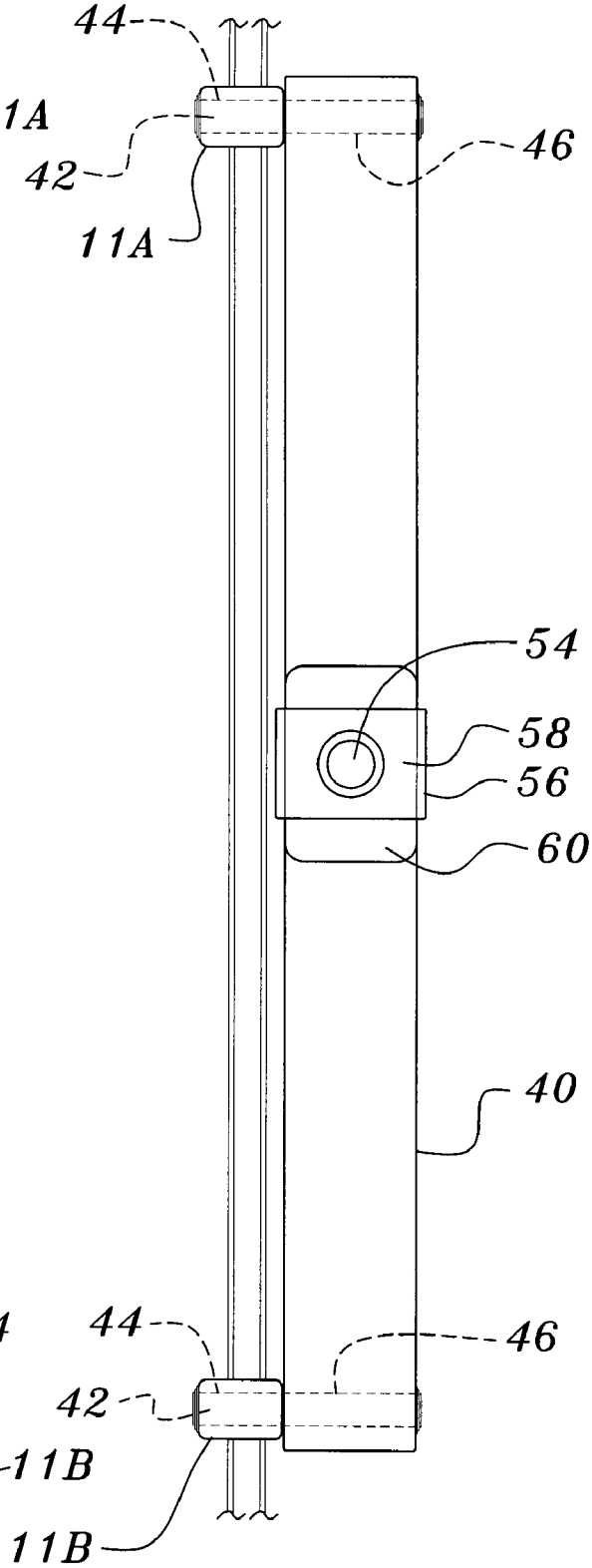
FIG. 7 is an enlarged rear view of the enhancer assembly of FIG. 1 showing the manner in which the enhancer is positioned to the outside of the axis of the cables and connected thereto by means of cable guides.
Figure 11:
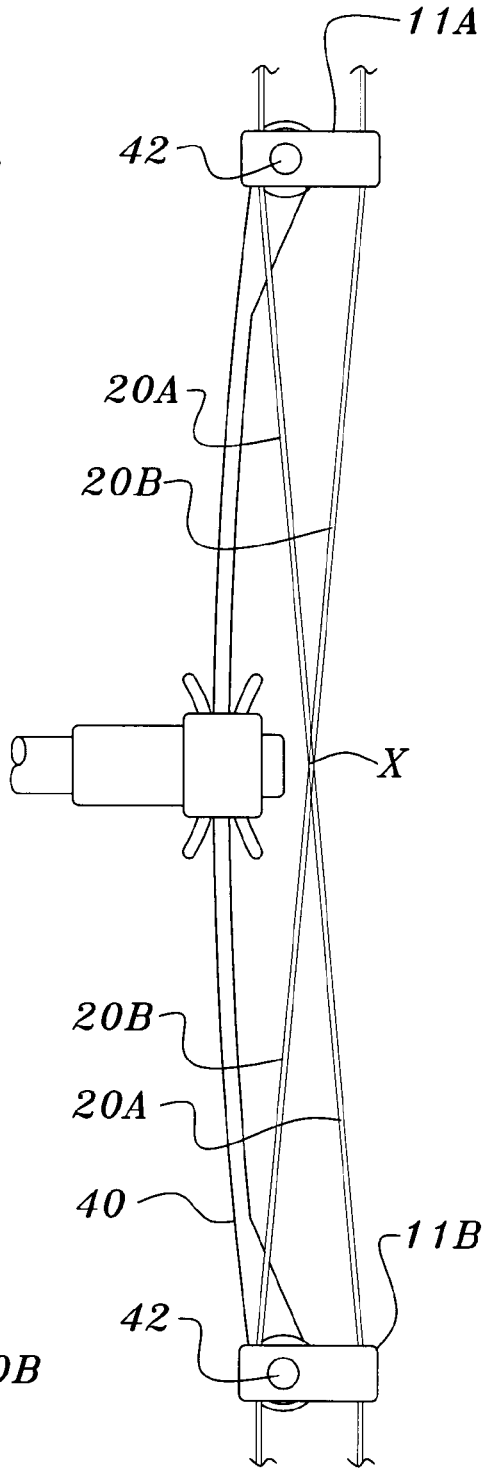
FIG. 11 is a side view of the enhancer assembly of the invention employing the first and second embodiments of the cable guides.
Figure 12:
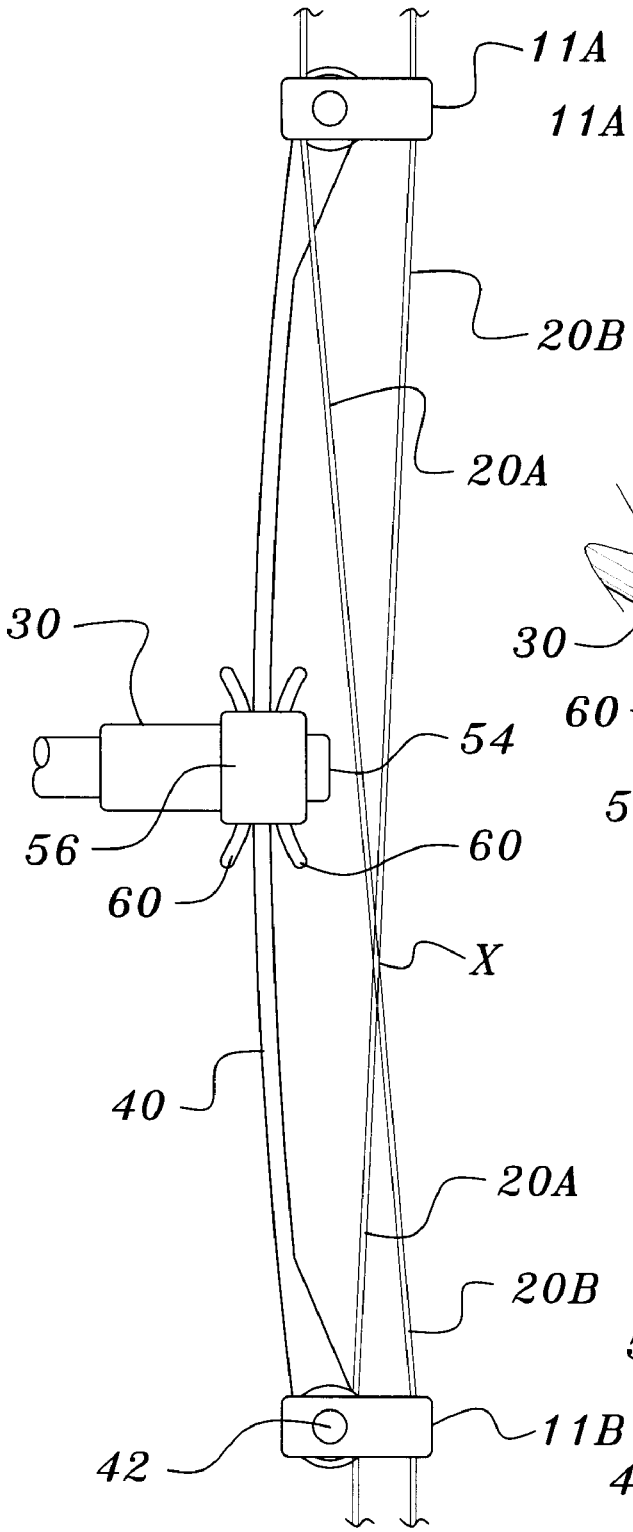
FIG. 12 is a side view of the enhancer assembly of the invention employing the first and third embodiments of the cable guides.
Figure 13:
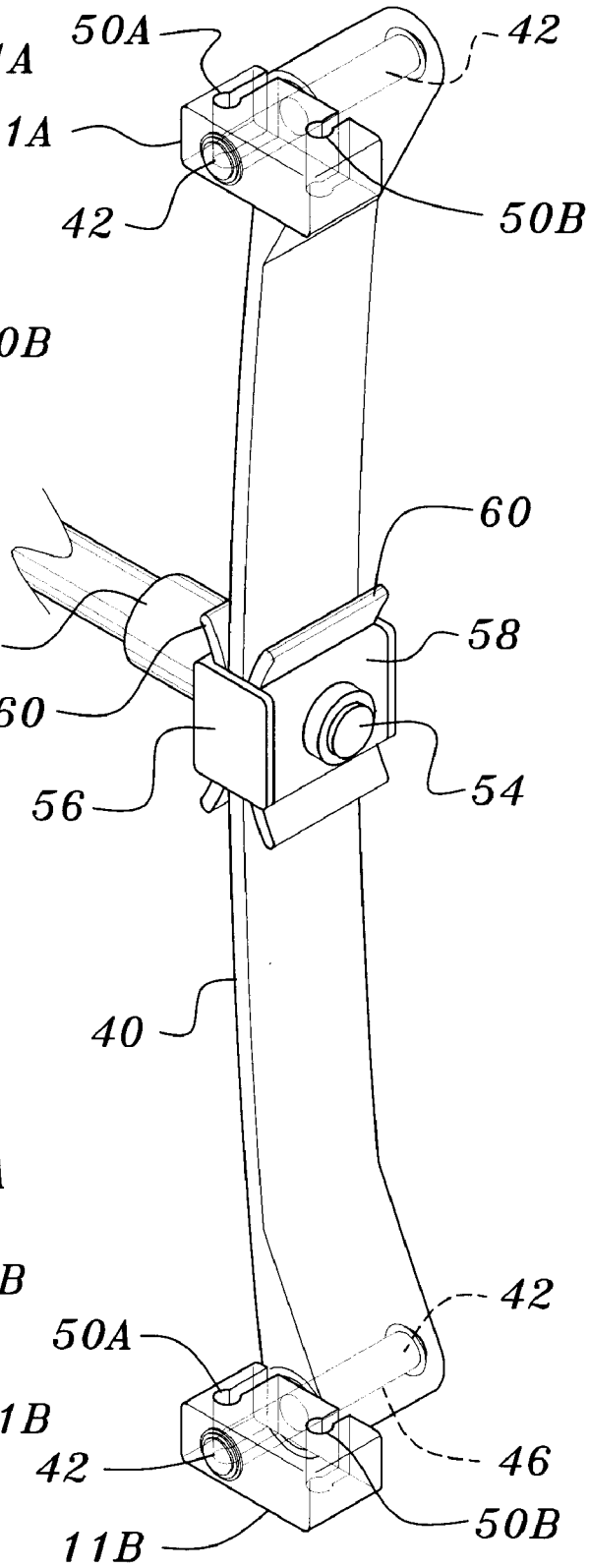
FIG. 13 is a perspective view of the enhancer assembly of the invention further including cushion plates for preventing undue fatigue on the fiberglass material.
Figure 21:
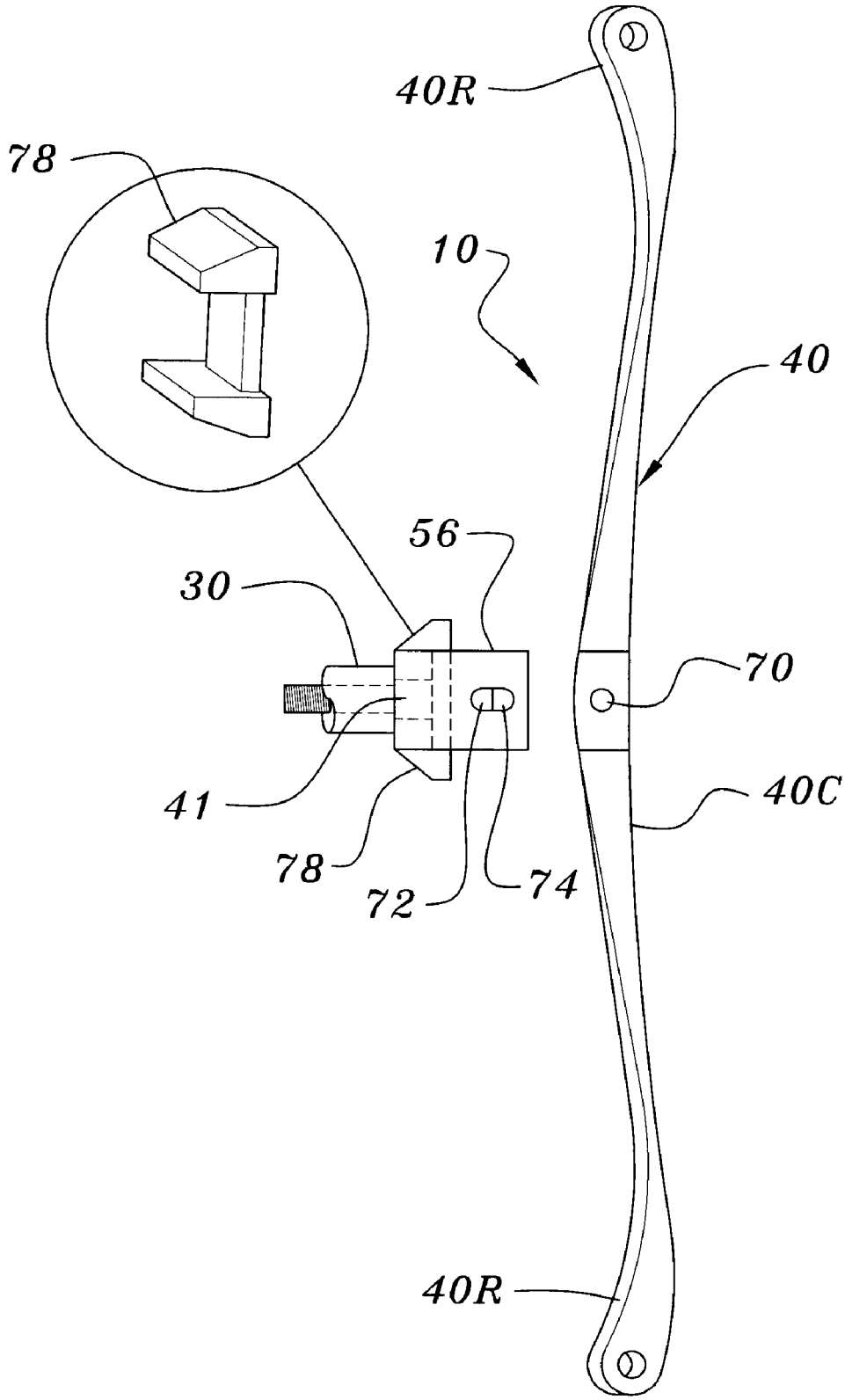
FIG. 21 is an opposite side view, partially exploded, of still another embodiment of the enhancer that includes a thickened middle portion to minimize fatigue and includes a re-curve configuration.

The various embodiments of cable guides 11A & 11B are paired so as to separate the cables 20 and prevent them from rubbing. For example, as shown in FIGS. 6 and 7, the embodiment of the cable guide of FIG. 8 may be used as both the upper and lower cable guides 11A and 11B to separate the cables 20A and 20B but allow them to cross-over at cross-over point X below the enhancer 40 (see FIGS. 1–5). Also for example, as shown in FIG. 11, the embodiment of the cable guide of FIG. 8 may be used as the upper cable guide 11A and paired with that of FIG. 9 to be used as the lower cable guide 11B to separate the cables 20A and 20B but allow them to cross-over at cross-over point X therebetween. Still further for example, as shown in FIG. 12, the embodiment of the cable guide of FIG. 8 may be used as the upper cable guide 11A and paired with that of FIG. 10 to be used as the lower cable guide 11B to separate the cables 20A and 20B but allow them to cross-over at cross-over point X therebetween. As shown in FIG. 13, the embodiment of the cable guides 11A & 11B of FIG. 9 may be used as both the upper and lower cable guides 11A and 11B to separate the cables 20A and 20B but allow them to cross-over at cross-over point X below the enhancer 40. As another example, as shown in FIG. 21, the embodiment of the cable guide of FIG. 10 may be used as the upper cable guide 11A and paired with that of FIG. 10A to be used as the lower cable guide 11B to separate the cables 20A and 20B but allow them to cross-over at cross-over point X therebetween.

In each of the foregoing, the complementary depths and positions of the slots 50 relative to the respective pivot pin 42 compensates for the tendacy of the enhancer 40 to twist due to the offset positioning of the enhancer assembly 10 from the path of the bowstring 20. Then enhancer 40 is therefore arced rearwardly more planarly while minimizing torquing.

Figure 14:
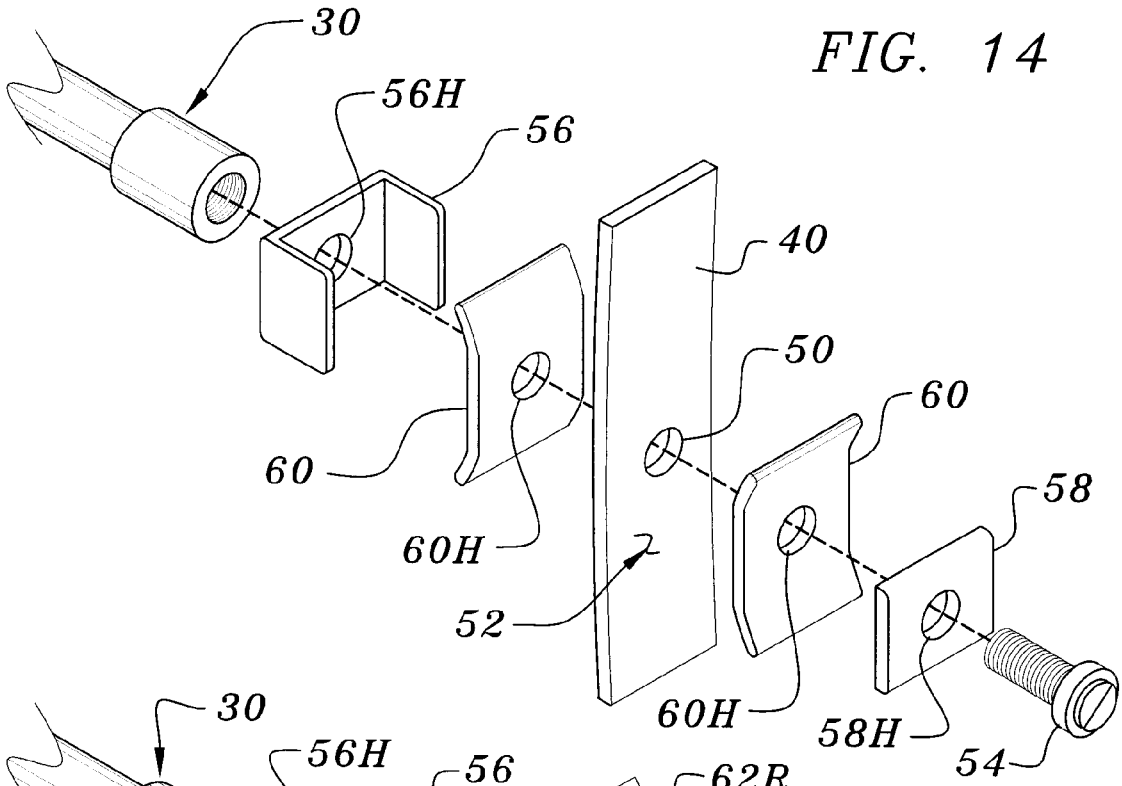
FIG. 14 is an exploded view of FIG. 13.
Figure 15:
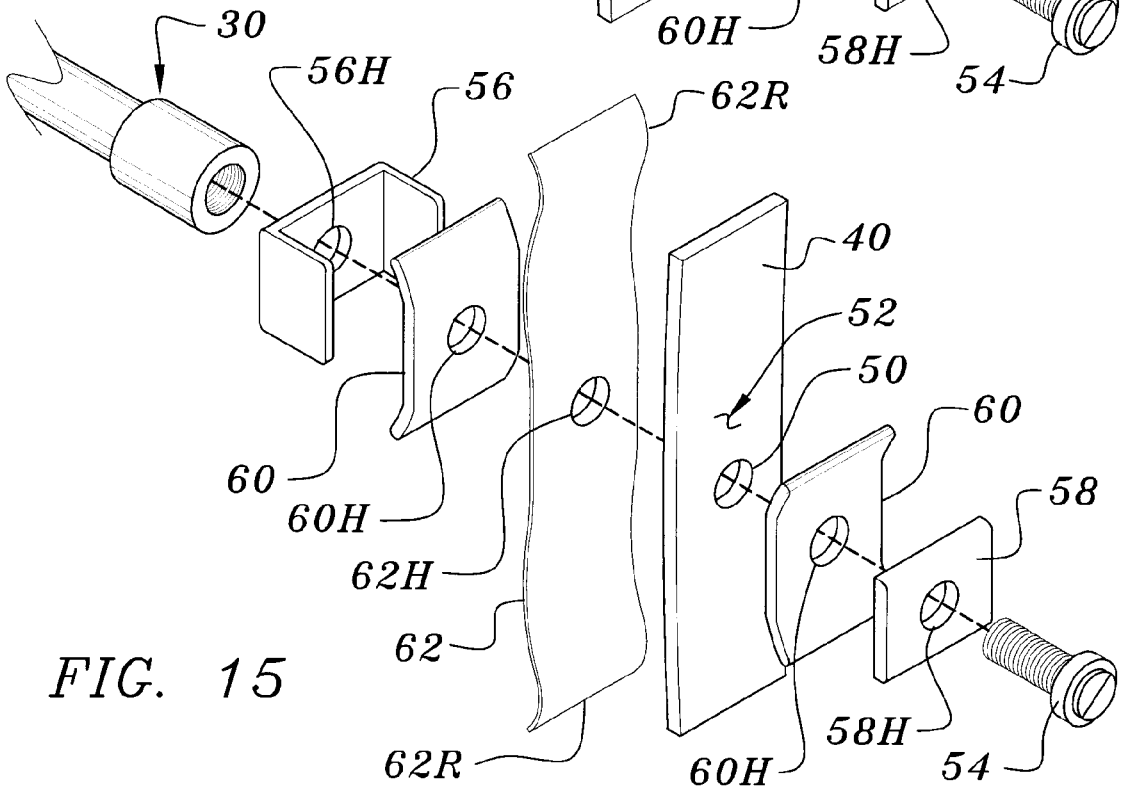
FIG. 15 is an exploded view of FIG. 13 further including a leaf spring positioned forwardly of the enhancer.
Figure 16:
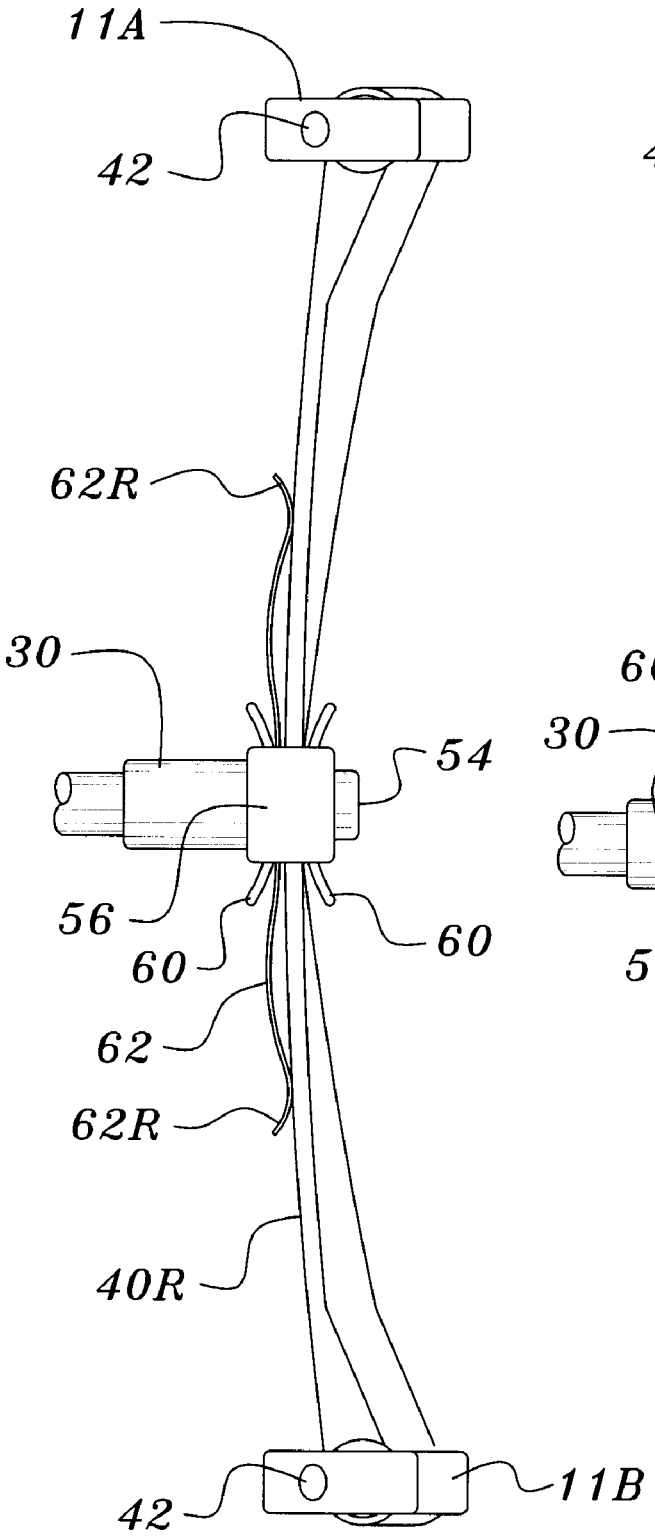
FIG. 16 is a side view of the assembled enhancer of FIG. 15 wherein the enhancer includes an inward longitudinal twist.

FIG. 14 is a partial exploded rear view of the enhancer assembly 10 showing greater detail the components thereof. More particularly, the enhancer 40 is attached to the proximal end of the bracket 30 by means of a hole 50 formed in the mid-portion 52 thereof to receive a mounting screw or bolt 54 to firmly attach the enhancer 40 to the proximal end of bracket 30. A square retainer 56 into which is fitted a square washer 58 may be provided on opposing sides of the enhancer 40 to maintain orientation without movement relative to the bracket 30. Further, a pair of slightly arcuate cushion members 60, preferably composed hard rubber of a high durometer of approximately 80, may be positioned on opposing sides of the enhancer 40 to further reduce shock and noise. Alternatively, it is noted that the cushion member 60 may each be composed of a metal with a rubber pad positioned between its mating surface with the enhancer 40. Finally, as shown in FIG. 15, a leaf spring 62 may be positioned between the enhancer 40 and the bracket 30. The leaf spring 62 functions to further minimize stress imposed in the enhancer 40 from riding against the cushion members 60 and increase forward dampening of the enhancer 40. In this regard, as best shown in FIG. 16, it is noted that the leaf spring 62 preferably includes re-curved ends 62R that facilitate riding along the front of the enhancer 40 during forward flexing. As shown throughout FIGS. 1–16, the retainer 56, washer 58, cushions 60 and leaf spring 62 are held securely into position by the threaded fastener 54 that extends through aligned holes 56H, 58H, 60H and 62H therein.

As alluded to earlier, due to the offset positioning of the enhancer assembly 10, an outward twisting force is imparted to the enhancer 40 itself during drawing of the bowstring 20. In order to compensate for such twisting force, the enhancer 40 may be manufactured with a built-in twist as shown in FIG. 16 in lieu of being formed more planar as shown in the previous embodiments of the enhancer 40. Preferably, the degree of twist is on the order of 2 to 10 degrees in the inward direction toward the bowstring 20. More preferably, the degree of twist is on the order of 3 to 4 degrees. In this manner, as the enhancer 40 is twisted outwardly during drawing of the bowstring 20 to the full draw length, the enhancer 40 will tend to "straighten up" to a planar configuration with minimal or no twisting when drawn.

Figure 17:
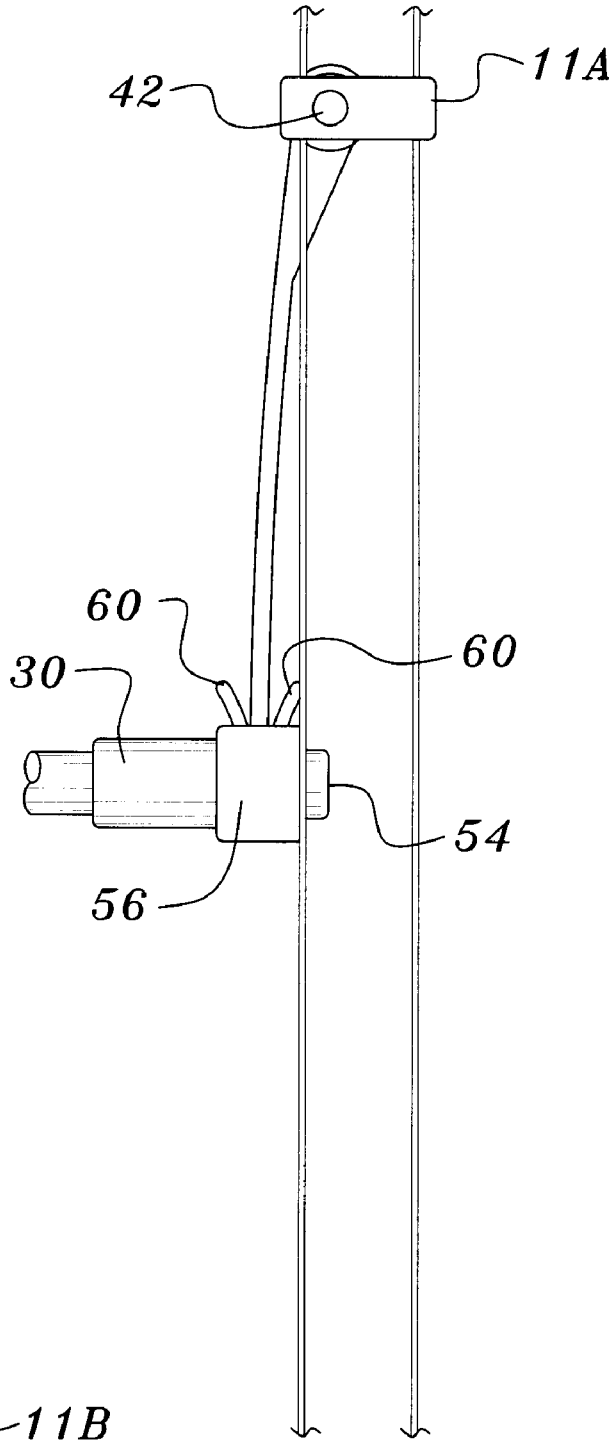
FIG. 17 is a side view of a unilateral version of the enhancer assembly of the invention.

The enhancer assembly 10 as described above comprises a generally bilateral configuration extending bilaterally from the bracket 30. As shown in FIG. 17, the enhancer assembly 10 may alternatively (but less preferably) extend unilaterally from the bracket 30 with corresponding unilateral cushion members 60, either upwardly (as shown) or downwardly, and be fitted with only one cable guide 11A & 11B.

Figures 18, 19:
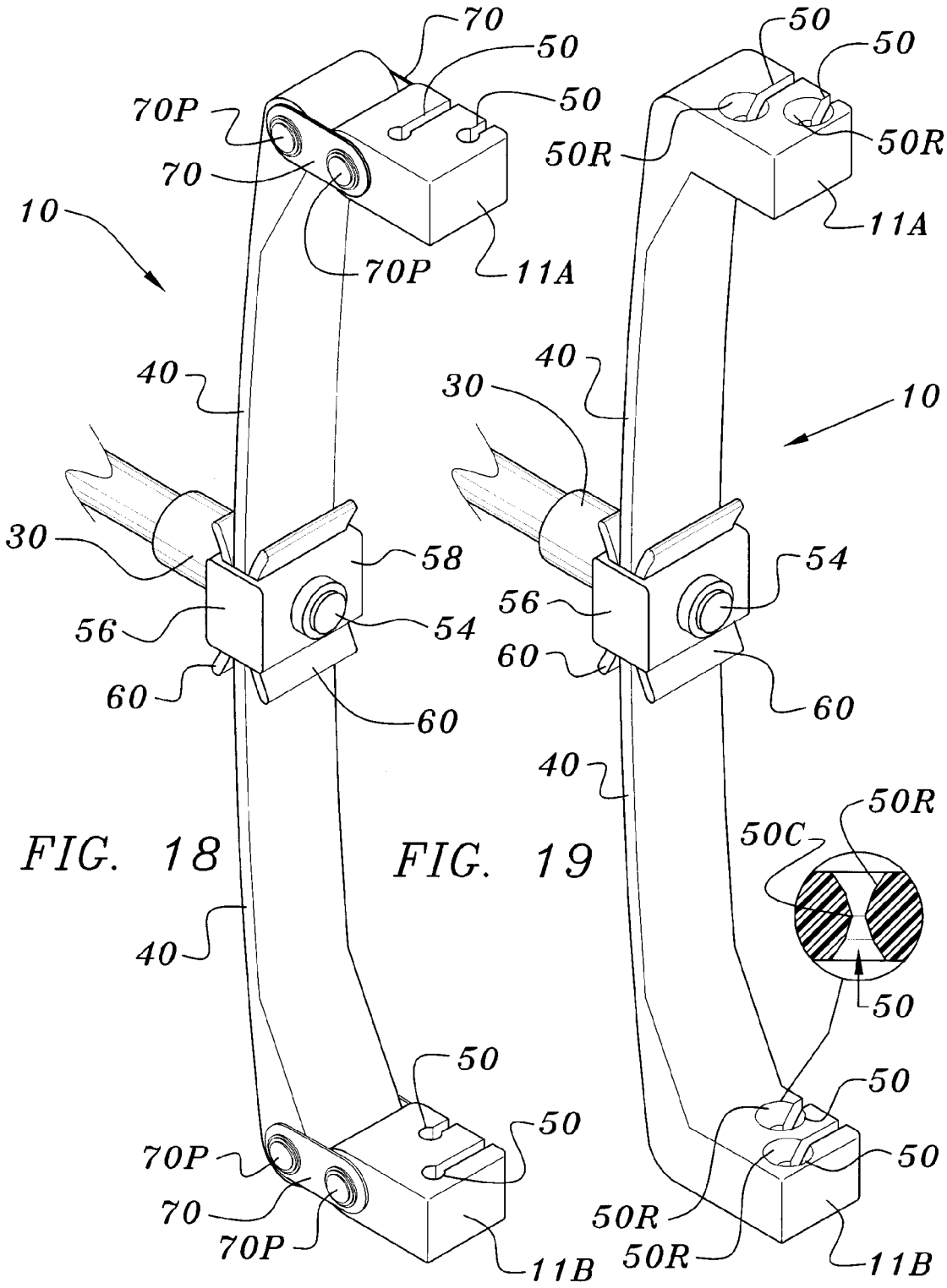
FIG. 18 is a perspective view of another embodiment of the enhancer assembly of the invention wherein the cable guides are linked to the enhancer.
FIG. 19 is a perspective view of still another embodiment of the enhancer assembly of the invention wherein the cable guides are made integral to the enhancer.

As shown in FIG. 18, the enhancer assembly 10 may be fitted with linked cable guides 11A & 11B. In this embodiment, the cable guides 11A & 11B comprises a generally rectangular configuration with slots 50 of substantially equal depth for receiving the respective cables 20. A pair of opposing links 70 are positioned on opposing sides of the cable guides 11A & 11B and are pivotally connected thereto and to the bulbous end of the enhancer 40 by respective pivot pins 70P. In this embodiment, the cable guides 11A & 11B are advantageously in the same plane as the enhancer 40.

The various embodiments of cable guides 11A & 11B described above are preferably manufactured from a lightweight material that is self-lubricating. That the cable guides 11A & 11B are lightweight is important to minimize inertia. It is noted that likewise, the pivot pins 42 and 70P are also preferably composed of a lightweight material (e.g., aluminum or composite plastic) to minimize inertia. That the cable guides 11A & 11B are composed of a self-lubricating material is important to minimize friction between the cables 20 sliding within the slots 50.

FIG. 19 illustrates still anther embodiment of the enhancer assembly 10 in which the cable guides 11A & 11B are integrally formed with the enhancer 40 itself Similar to those if FIG. 18, the cable guides 11A & 11B are positioned in the same plane as the enhancer 40 but do not pivot. Instead, in this embodiment of FIG. 19, the slots 50 are provided with countersunk recesses 5OR extending inwardly from the upper and lower surfaces thereof to meet at a center portion 50C. The countersunk recesses 5OR meeting at the center portion 50C obviate the need for the cable guides 11A & 11B to be pivotally connected to the enhancer 40 as in the previous embodiments as the cables 20 themselves are allowed sufficient room to pivot within the recesses 50R without binding.

Figure 20:
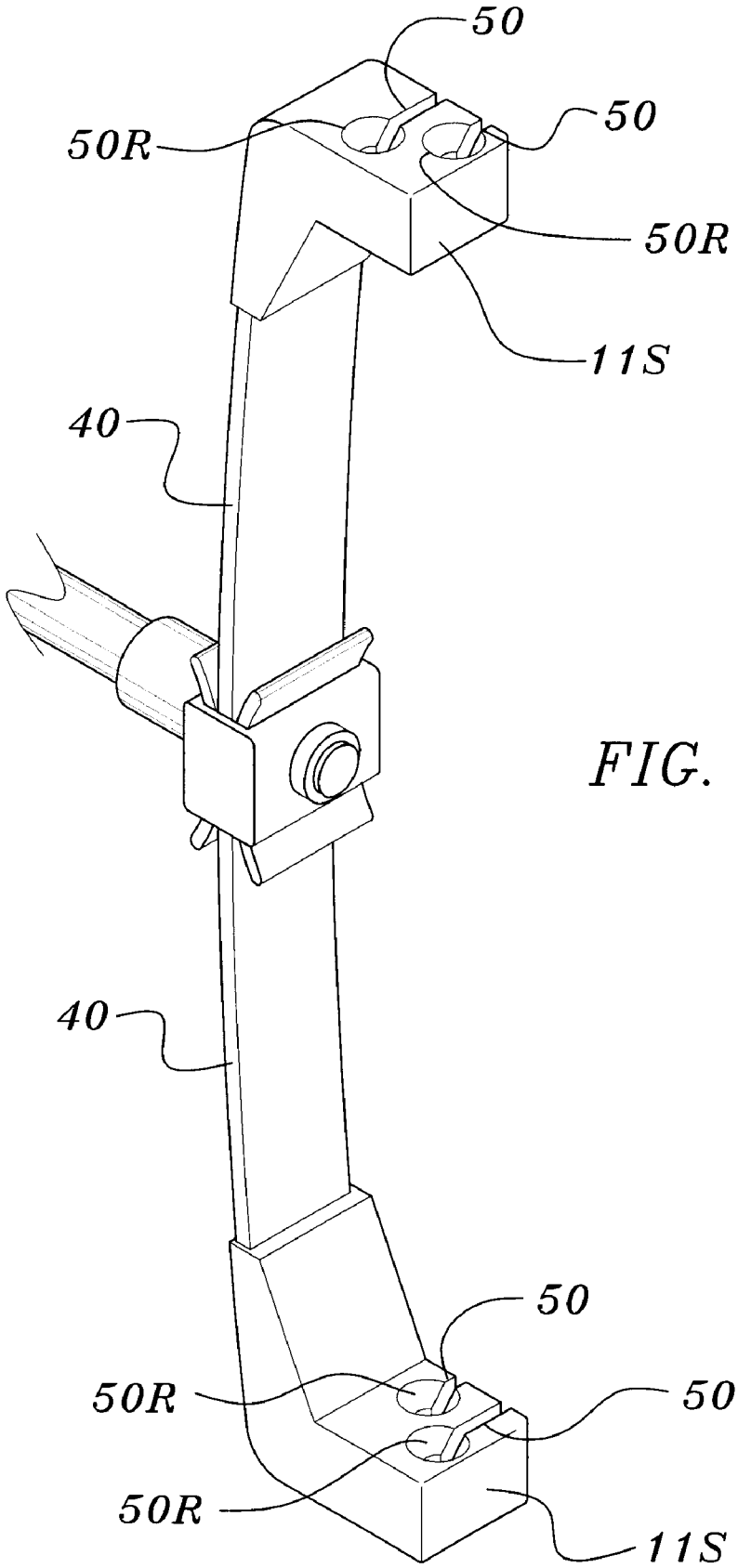
FIG. 20 is a perspective view of still another embodiment of the enhancer assembly of the invention wherein the cable guides are pivotally connected to the enhancer by means of sockets that fit over the ends of the enhancer.

FIG. 20 is a perspective view of still another embodiment of the enhancer assembly 10 of the invention wherein the various embodiments of the cable guides 11A & 11B are connected to the enhancer 40 by means of sockets 11S that are fitted over the ends of the enhancer 40 and rigidly secured thereto such as by crimping, an adhesive, or the like. The sockets 118 may be integral with the cable guides 11A & 11B similar to FIG. 19 or may be linked or pivoted to the cable guides 11A & 11B similar to other Figs.

Finally, FIG. 21 is a side view of the most preferred embodiment of the enhancer assembly 10 of the invention wherein the enhancer 40 includes a thickened middle portion 40C to minimize fatigue and includes a re-curve configuration 40R at the ends of the enhancer 40. In this most preferred embodiment, the square retainer 56 is rigidly connected to the proximal end of the bracket 30 by a flat-headed fastener 41 (screw, rivet, etc), by welding, by an adhesive, or the like. The thickened middle portion 40C is provided with a transverse pivot pin hole 70. The opposing sides of the square retainer 56 is likewise provided with transverse holes 72 in alignment therewith. A pivot pin 74 is positioned through holes 70 and 72 to pivotally connect the enhancer 40 to the proximal end of the bracket 30.

Preferably a rubber cushion 78 is seated within the retainer 56 between the retainer 56 and the enhancer 40. Also preferably the pivot pin hole 72 is oblong in configuration. In this manner, the rubber cushion 78 is under some compression when assembled and held into position by the pivot pin 74 yet further cushioning is possible due to the oblong nature of the hole 72, thereby further reducing hand shock and vibrations. Finally, it is noted that the pivot pin 74 may be sleeved with a self-lubricating bushing and/or a cushioned bushing to reduce friction and to further reduce hand shock, respectively.

In the most-preferred embodiment of FIG. 21, the thickened middle portion serves to provide a thickness in which to form the hole 70 while reducing bending of the enhancer 40 along the middle portion thereof. The flexibility of the enhancer 40 to be drawn rearwardly during drawing of the bowstring 20, is still maintained, however, due to the re-curve configuration 40R of the enhancer 40.

In all embodiments, the enhancer assembly 10 of the invention achieves significant reductions in hand shock and noise than was found in my prior vibraguard as taught in my prior patent (U.S. Pat. No. 4,834,061). In contrast to my prior vibraguard that was made from spring steel, this is attributed in large part to the enhancer 40 being composed of a non-metal material such as a synthetic plastic, most preferably, compression-molded fiberglass as described above. It is believed that the use of enhancer assembly 10 of the invention in a conventional compound bow significantly increases the bow's dynamic efficiency.

Furthermore, it has been discovered that optimal shock and noise reduction is achieved without increasing the draw weight or draw length or reducing arrow speed, by configuring the enhancer 40 so that it may sufficiently flex rearwardly during drawing of the bowstring 20 without "pulling" on the cables 20 and forcing them from otherwise extending straight across from the ends of the bow limbs 16 (see FIG. 3 wherein the cables 20 still extend straight across between the ends of the bow limbs 16 without any forward pulling by the enhancer 40). Conversely, if the flex of the enhancer 40 is too strong to cause the cables 20 to be pulled forwardly during drawing of the bowstring 20, an increase in the draw weight and draw length occurs.

Furthermore, as noted above in connection with FIG. 2, the enhancer assembly 10 may be positioned in a "pre-loaded" position with the length $L_{load}$ of the bracket 30 being shortened to position the enhancer assembly 10 forwardly of the at-rest position ($L_{load}<L_{rest}$). Pre-loading of the enhancer assembly 10 increases the speed of flight of the arrow and while further minimizing shock and noise. However, as set forth in the following chart, as the enhancer assembly 10 is more and more pre-loaded, the draw weight and draw length increases from being imperceptible to being measurable:

| Product | Pre-loading Amount ($L_{rest}$ minus $L_{load}$) | Arrow Speed | Draw Weight | Draw Length |
|---|---|---|---|---|
| conventional cable guard | N/A | 261 fps | 60 lbs. | 29 inches |
| invention | 0* | 286 fps | 59.5 lbs. | 29 inches |
| invention | ¼ inch | 287 fps | 60 lbs. | 29 ⅛ inches |
| invention | ⅜ inch | 288 fps | 61 lbs. | 29 ⅛ inches |

*embodiment of FIG. 21, at rest, no pre-loading (with lightweight aluminum pivot pin)

Thus, it should be appreciated from the forgoing table that a conventional compound bow may be set at less draw length and weight and the enhancer assembly 10 of the invention installed thereon in a pre-loaded position, to achieve significantly less shock and noise and a meaningful increase in arrow speed.

The present disclosure includes that contained in the appended claims as well as that of the foregoing description.

Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. An enhancer assembly for connection to a compound bow by means of a bracket that mounts the enhancer assembly to the compound bow at a position proximate to the cables in a position off-set from the bowstring to retain the cables from being in the path of the bowstring, the enhancer assembly comprising in, combination:

an enhancer composed of a non-metal material, said enhancer being positioned at a pre-loaded position to pre-load the cables; and at least one cable guide connected to one end of said enhancer for slidably receiving the cables;

whereby the enhancer reduces the amount of shock and noise produced upon release of the drawn bowstring to propel an arrow.

2. The enhancer assembly as set forth in claim 1, wherein said enhancer comprises a planar configuration.

3. The enhancer assembly as set forth in claim 1, wherein said enhancer comprises a thickened middle portion.

4. The enhancer assembly as set forth in claim 3, wherein said enhancer comprises a re-curve configuration.

5. The enhancer assembly as set forth in claim 1, wherein said enhancer comprises a twist configuration.

6. An enhancer assembly for connection to a compound bow by means of a bracket that mounts the enhancer assembly to the compound bow at a position proximate to the cables in a position off-set from the bowstring to retain the cables from being in the path of the bowstring, the enhancer assembly comprising in combination:

an enhancer composed of a non-metal material, said enhancer comprising a bilateral configuration and wherein another one of said cable guides is connected to another one of said ends of said enhancer for slidably receiving the cables, said enhancer being positioned at a pre-loaded position to pre-load the cables; and at least one cable guide connected to one end of said enhancer for slidably receiving the cables;

whereby the enhancer reduces the amount of shock and noise produced upon release of the drawn bowstring to propel an arrow.

7. The enhancer assembly as set forth in claim 6, wherein said enhancer comprises a planar configuration.

8. The enhancer assembly as set forth in claim 6, wherein said enhancer comprises a thickened middle portion.

9. The enhancer assembly as set forth in claim 8, wherein said enhancer comprises a re-curve configuration.

10. The enhancer assembly as set forth in claim 6, wherein said enhancer comprises a twist configuration.

11. An enhancer assembly for connection to a compound bow by means of a bracket that mounts the enhancer assembly to the compound bow at a position proximate to the cables in a position off-set from the bowstring to retain the cables from being in the path of the bowstring, the enhancer assembly comprising in combination:

an enhancer composed of a non-metal material, and at least one cable guide connected to one end of said enhancer for slidably receiving the cables, each said cable guide being integrally formed with said enhancer;

whereby the enhancer reduces the amount of shock and noise produced upon release of the drawn bowstring to propel an arrow.

12. An enhancer assembly for connection to a compound bow by means of a bracket that mounts the enhancer assembly to the compound bow at a position proximate to the cables in a position off-set from the bowstring to retain the cables from being in the path of the bowstring, the enhancer assembly comprising in combination:

an enhancer composed of a non-metal material;

a cushion plate positioned between said enhancer and the bracket; and at least one cable guide connected to one end of said enhancer for slidably receiving the cables;

whereby the enhancer reduces the amount of shock and noise produced upon release of the drawn bowstring to propel an arrow.

13. An enhancer assembly for connection to a compound bow by means of a bracket that mounts the enhancer assembly to the compound bow at a position proximate to the cables in a position off-set from the bowstring to retain the cables from being in the path of the bowstring, the enhancer assembly comprising in combination:

an enhancer composed of a non-metal material;

a leaf spring positioned between said enhancer and the bracket; and at least one cable guide connected to one end of said enhancer for slidably receiving the cables;

whereby the enhancer reduces the amount of shock and noise produced upon release of the drawn bowstring to propel an arrow.

14. The enhancer assembly as set forth in claim 13, wherein said leaf spring comprises a re-curve configuration.

15. A method for reducing shock and noise and increasing dynamic efficiency in a compound bow, comprising the step of positioning an enhancer composed of a non-metal material with at least one cable guide in alignment with bowstring cables for exerting a force on the bow cables while the bow cables are at a rest position, during drawing of the bowstring and during release of the drawn bowstring.

16. A method for increasing the speed of a bowstring of a compound bow relative to a handle of said compound bow, comprising the step of constantly applying a force to bowstring cables of the bow by an enhancer composed of a non-metal material to urge the bow cables forwardly after the bowstring cables are released after being drawn.

17. The method as set forth in claim 16, further including the step of constantly applying the force to the bowstring cables of the bow by the enhancer while the bowstring cables are at rest.

18. The method as set forth in claims 16 or 17, further including the step of increasing the force imparted to the bow cables relative to the handle of said compound bow to further increase the speed of the bowstring relative to the handle of said compound bow.

19. The method as set forth in claims 16, or 17, further including the step of decreasing the force imparted to the bow cables to decrease the speed of the bowstring.

20. The method as set forth in claims 16 or 17, further including the step of increasing the dynamic efficiency of the bow.

21. The method as set forth in claims 16 or 17, further including the step of decreasing the static inertia of the bowstring cables.

* * * * *